US010939766B2

(12) United States Patent
Weterrings et al.

(10) Patent No.: US 10,939,766 B2
(45) Date of Patent: Mar. 9, 2021

(54) COOLER MOUNTING SYSTEM

(71) Applicant: The Wise Company, Memphis, TN (US)

(72) Inventors: Frans Weterrings, Memphis, TN (US); Bruce Whitmer, Memphis, TN (US); Rocky Martini, Memphis, TN (US); Michael Monroe, Memphis, TN (US); Butch Dingler, Memphis, TN (US)

(73) Assignee: The Wise Company, Memphis, TN (US)

( * ) Notice: Subject to any disclaimer, the term of this patent is extended or adjusted under 35 U.S.C. 154(b) by 0 days.

(21) Appl. No.: 16/205,494

(22) Filed: Nov. 30, 2018

(65) Prior Publication Data

US 2019/0159599 A1 May 30, 2019

Related U.S. Application Data

(60) Provisional application No. 62/592,492, filed on Nov. 30, 2017.

(51) Int. Cl.

| | |
|---|---|
| ***F25D 3/08*** | (2006.01) |
| ***A47C 7/62*** | (2006.01) |
| ***F25D 23/00*** | (2006.01) |
| *B63B 29/04* | (2006.01) |

(52) U.S. Cl.

CPC ..... *A47C 7/628* (2018.08); *F25D 23/00* (2013.01); *B63B 2029/043* (2013.01); *F25D 3/08* (2013.01)

(58) Field of Classification Search

USPC ... 248/229.25, 229.24, 228.6, 228.5, 231.71, 248/231.61, 316.1, 316.6; 224/524

See application file for complete search history.

(56) References Cited

U.S. PATENT DOCUMENTS

| | | | | |
|---|---|---|---|---|
| 5,818,695 | A * | 10/1998 | Olson | H01L 23/4093 361/719 |
| 6,434,004 | B1 * | 8/2002 | Matteson | H01L 23/4093 165/80.3 |
| 6,507,491 | B1 * | 1/2003 | Chen | H01L 23/4006 165/121 |
| 10,429,116 | B2 * | 10/2019 | Huish | A45C 13/262 |
| 2019/0315519 | A1 * | 10/2019 | Brennan | B65D 25/20 |

* cited by examiner

*Primary Examiner* — Alfred J Wujciak

(74) *Attorney, Agent, or Firm* — Barnes & Thornburg LLP

(57) ABSTRACT

A cooler mounting system is provided. The cooler mounting system includes at least one front bracket system and at least on rear bracket system. Each bracket system includes at least one arm portion and a base portion. The mounting system also includes a cooler that includes a front rail portion located on a front face of the cooler and a rear rail portion located on a rear face of the cooler.

12 Claims, 8 Drawing Sheets

COOLER MOUNTING SYSTEM

CROSS REFERENCE TO RELATED APPLICATION

This application claims priority to U.S. Application Ser. No. 62/592,492, filed on Nov. 30, 2017, which is incorporated by reference herein in its entirety.

BACKGROUND OF THE INVENTION

Coolers are often utilized for both seating and cooling of food and drink items in various sporting, pleasure and work environments. Coolers are particularly utilized in personal or even commercial watercraft and may be toted and placed inside the watercraft just before use. Some personal watercraft utilize a cooler with a cushion for permanent seating. In either embodiment, movement and placement of the cooler in a single space may prove challenging. Existing technology utilizes permanent bumpers or corners that are bolted to the floor of the watercraft along with flexible tie downs or ropes that engage the cooler handle and bumper to keep the cooler from moving during watercraft movement. Such a design still allows form upward and some side-to-side movement. There exists a need for a cooler mounting system that overcomes these challenges.

SUMMARY OF THE INVENTION

According to one aspect, a cooler mounting system is provided. The system includes at least one front bracket system comprising at least one arm portion and a base portion. The system also includes at least one rear bracket system comprising at least one arm portion and a base portion. The system further includes a cooler comprising a front rail portion located on a front face of the cooler and a rear rail portion located on a rear face of the cooler. According to one embodiment, the at least one front bracket system includes at least two protruding arm portions. According to one embodiment, the at least one arm portion and the base portion of the front bracket system are configured to engage the front rail portion. According to one embodiment, the at least one arm portion and the base portion of the rear bracket system are configured to engage the rear rail portion. According to one embodiment, the system further includes at least four feet, wherein the feet are of a vertical thickness so as to allow for alignment of: (a) the front rail portion between the at least two arm portions and base portion of the front bracket system; and (b) the rear rail portion between the at least one single arm portion and base portion of the rear bracket system. According to one embodiment, the least two arm portions and base portion of the front bracket system are formed from a single piece of material. According to one embodiment, the system includes two front bracket systems. According to one embodiment, the system includes two rear bracket systems. According to one embodiment, the rear bracket system includes a separate arm portion and base portion. According to one embodiment, the front bracket system includes a base portion having a top surface defining at least three openings that traverse the entire base portion and an arm portion having a top surface defining a single opening that traverses the entire arm portion. According to one embodiment, each of the three openings are configured to receive at least one fastener. According to one embodiment, the fastener is a screw. According to one embodiment, the rear bracket system includes a base portion having a top surface defining at least three openings that traverse the entire base portion. According to one embodiment, each of the three openings are configured to receive at least one fastener. According to one embodiment, the fastener is a screw.

According to one aspect, a method of securing a cooler in a watercraft is provided. The method includes the steps of providing a cooler mounting system as provided herein, securing the front bracket system to a deck surface of the watercraft, securing the base portion of the rear bracket system to the deck surface of the watercraft, placing the front rail portion between the at least one arm portion and the base portion of the front bracket system, and securing the arm portion of the rear bracket system against the rear rail portion and to the base portion of the rear bracket system.

DETAILED DESCRIPTION OF THE INVENTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the present disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

As used herein, the term "cooler" refers to an insulated box-like structure with a top for storing items that require a sub-ambient temperature. The cooler as provided herein may be of any size, dimension or shape that is suitable for typical use in a watercraft. The cooler as provided herein may be roto-molded or injection molded from any suitable plastic or polymer.

A cooler mounting system is provided. The cooler mounting system includes front and rear bracket systems that engage a front rail portion and rear rail portion on an exterior surface of a cooler. The cooler mounting system as provided herein allows for the cooler to be secured to a surface without the use of tie downs or ropes that may allow for movement and require additional parts to maintain and move each time the cooler is removed. The instant cooler mounting system allows a user to easily and efficiently secure the cooler to a surface and subsequently remove the cooler when desired.

Figure 1:
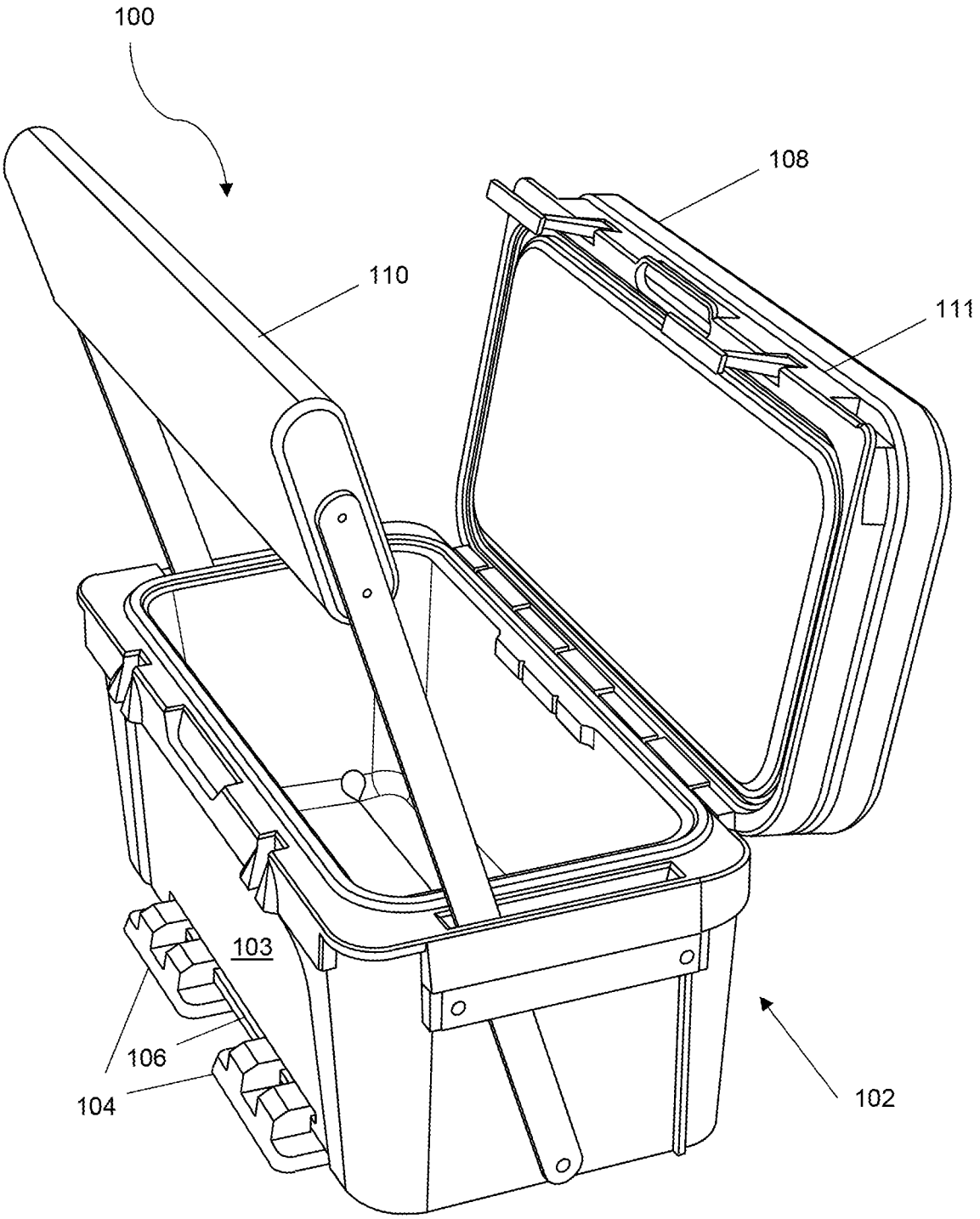
FIG. 1 is a front perspective view of a cooler mounting system.
Figure 3A:
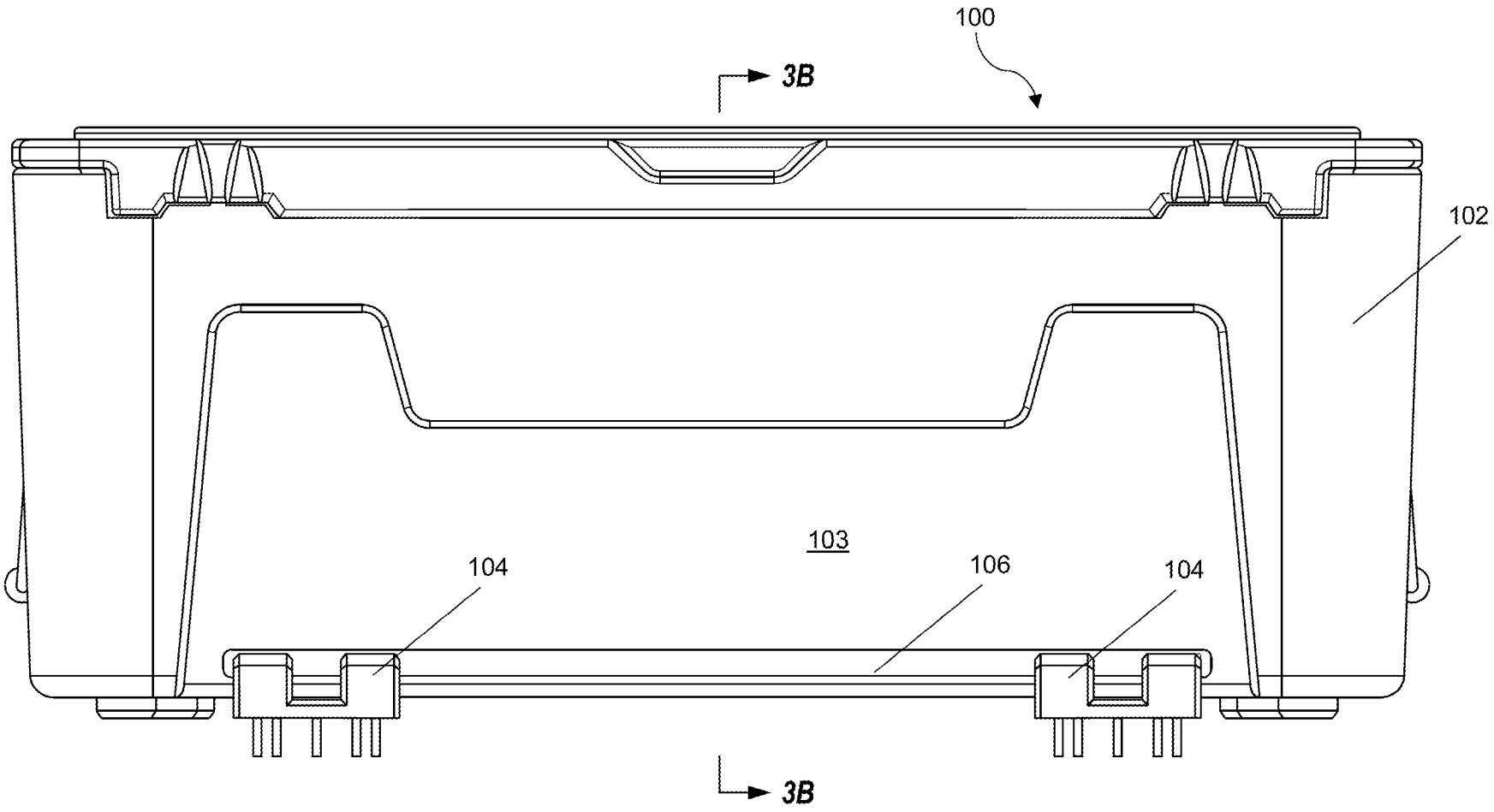
FIG. 3A is a front view of a cooler mounting system.

FIG. 1 provides a front perspective view of a cooler mounting system 100 according to one embodiment. FIG. 3A provides a front view of a cooler mounting system 100 according to one embodiment. As illustrated, the cooler mounting system 100 includes a cooler 102 and two front bracket systems 104. According to an alternative embodiment, the cooler 102 may include one or more front bracket systems 104. The cooler 102 includes a front rail portion 106 on a front face 103 of the cooler 102. The front rail portion 106 may be formed from the same material as the exterior of the cooler 102 and is molded in a horizontal manner parallel to a mounting surface 126 (see FIGS. 4B and 7B). According to an alternative embodiment, the front rail portion 106 may be fabricated from a different material such as, for example, stainless steel or other acceptable metal for environments regularly exposed to fresh or salt water. As illustrated, the cooler 102 is portable and does not depend on electricity to maintain a sub-ambient temperature environment inside the cooler 102. As illustrated, the cooler 102 optionally includes a cushion top 108 and cushion back 110, however, the cooler may simply have a plastic top 111 and no cushion back 110.

Figure 2:
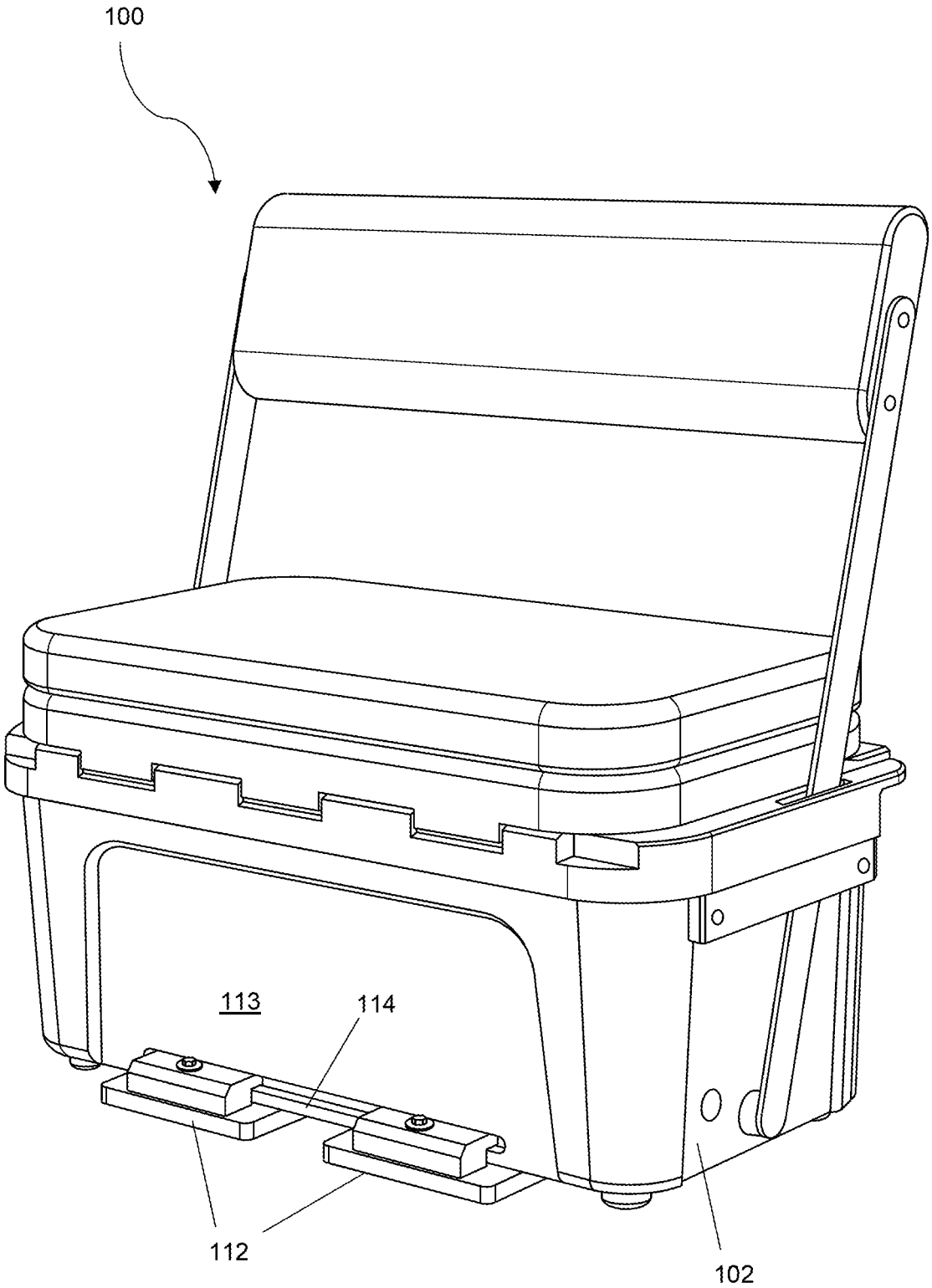
FIG. 2 is a rear perspective view of a cooler mounting system.

As illustrated in FIG. 2, the cooler mounting system 100 includes two rear bracket systems 112. The cooler 102 includes a rear rail portion 114 on a rear face 113 of the cooler 102. The rear rail portion 114 may be formed from the same material as the exterior of the cooler 102 and is molded in a horizontal manner parallel to a mounting surface (see FIGS. 4B and 7B). According to an alternative embodiment, the rear rail portion 114 may be fabricated from a different material such as, for example, stainless steel or other acceptable metal for environments regularly exposed to fresh or salt water.

Figure 3B:
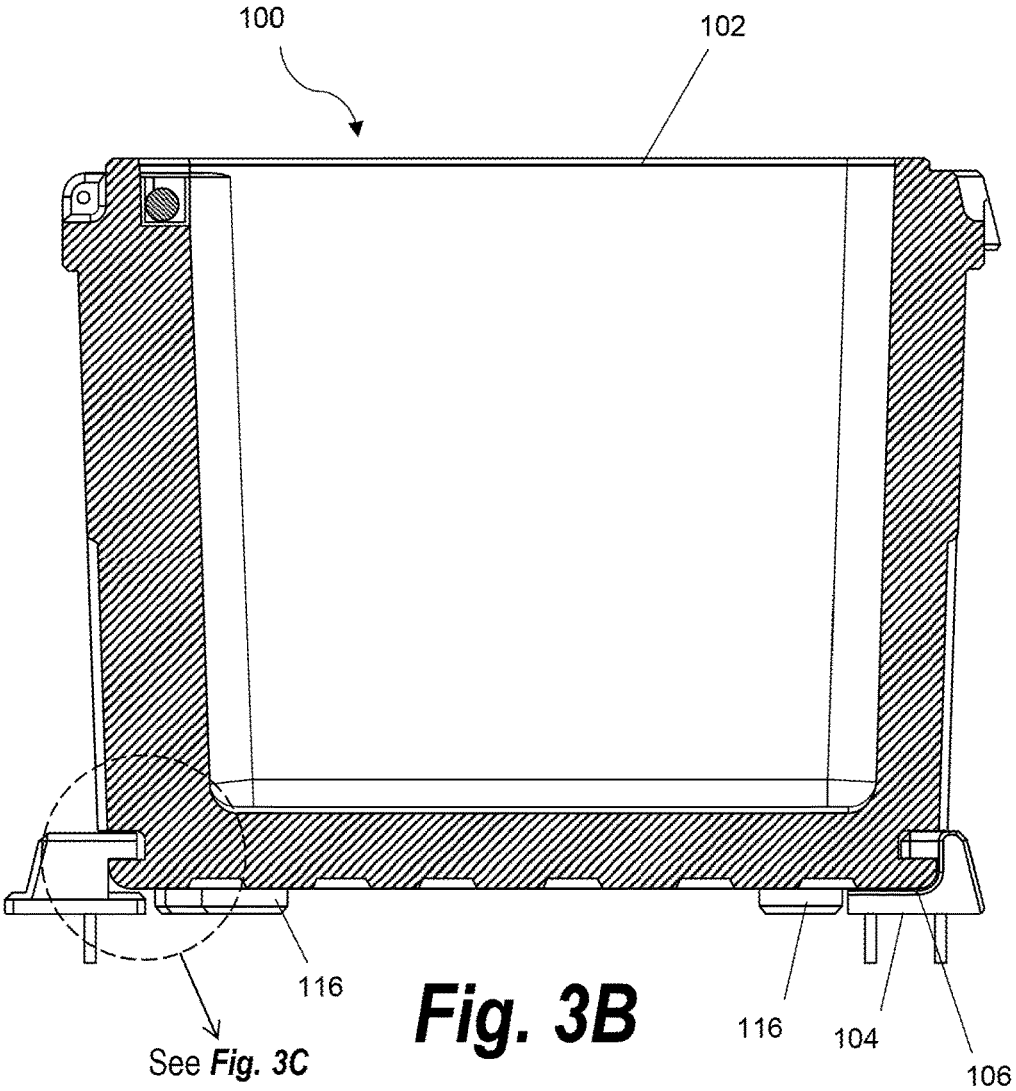
FIG. 3B is a cross-sectional view of a cooler mounting system along line 3B in FIG. 3A.

FIG. 3B provides a cross-sectional view of the cooler mounting system 100 along line 3B of FIG. 3A. The cooler 102 includes at least four feet 116 located in close proximity to each bracket system (104, 112). The cooler 102 may include a plurality of feet 116 according to an alternative embodiment (not shown). According to one embodiment, the cooler may include four feet 116. The feet 116 may be hi-rise feet according to one embodiment. The feet 116 may also be skid resistant (or non-skid). The feet 116 have a vertical height or thickness substantially equal to the base portions (120, 128) of each bracket system (104, 112). As illustrated throughout, the feet 116 are of a vertical thickness so as to allow for alignment of: (a) the front rail portion 106 between the at least two arm portions 118 and base portion 120 of the front bracket system 104; and (b) the rear rail portion 114 between the at least one single arm portion 130 and base portion 128. Each bracket system (104, 112) is shown securing, engaging, holding or otherwise gripping each rail portion (106, 114).

Figure 3C:
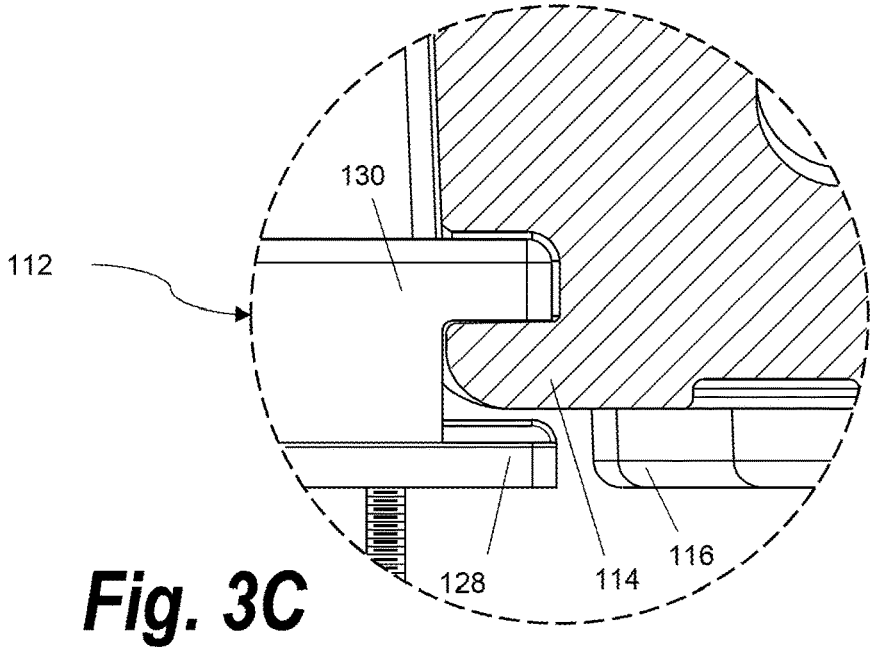
FIG. 3C is an exploded view of a rear bracket system shown in FIG. 3B.

FIG. 3C is an exploded view of a cross-sectional view of the rear bracket system 112. The rear bracket system 112 that includes a base portion 128 and at least one solid, single arm portion 130 that are separated pieces and secure, engage, hold or otherwise grip the rear rail portion 114. When separate base portion 128 and arm portion 130 are assembled, the rear bracket system 112 may form a substantially square, arcuate or rectangular area or orifice in which the rear rail portion 114 engages. The rear rail portion 114 is of a vertical thickness substantially similar to the distance between the arm portion 130 and base portion 128.

Figure 4A:
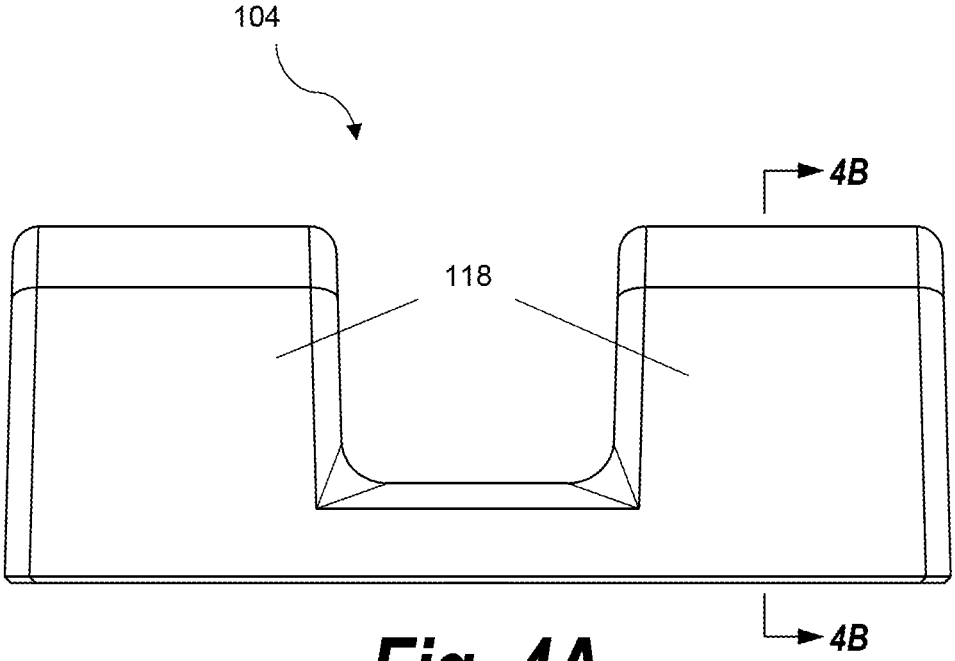
FIG. 4A is a rear view of a front bracket system.
Figure 4B:
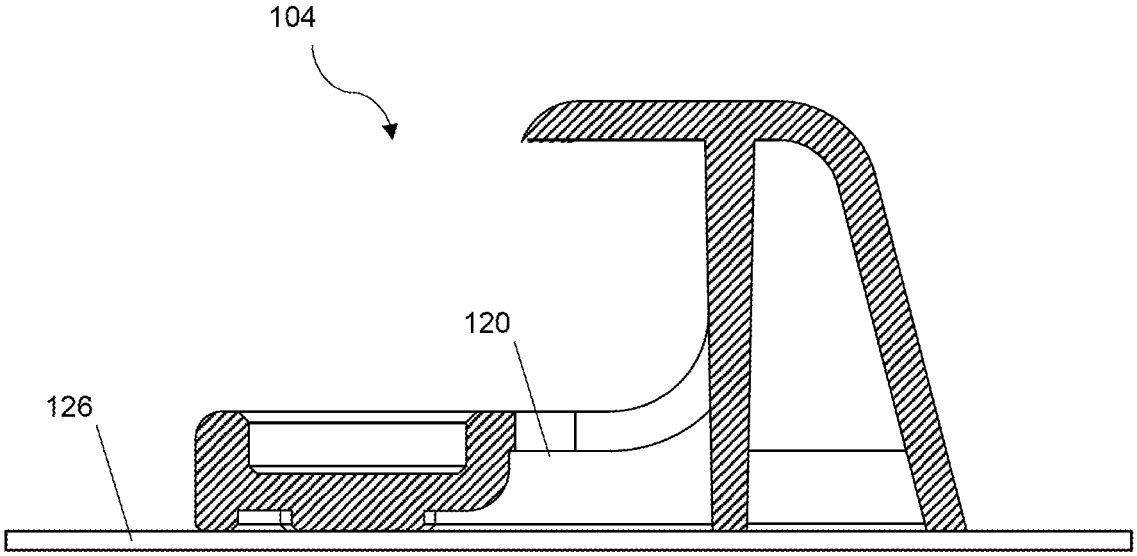
FIG. 4B is a cross-section view of the front bracket along line 4B.

FIG. 4A and FIG. 4B provide rear and cross-sectional views, respectively, of a front bracket system 104. The front bracket system 104 includes at least two protruding arm portions 118 and base portion 120 formed from a single piece of material to form the front bracket system 104 as a single unit. Thus, the front bracket system 104 does not contain a separate arm portion 118 and separate base 120. The base portion may for a substantially arcuate shape with the arm portions 118. The front rail portion 106 is of a vertical thickness substantially similar the distance between the two arm portions 118 and base portion 120. Thus, the two arm portions 118 and base portion 120 secure, engage, hold or otherwise grip the front rail portion 106 (see FIGS. 1 and 3B). According to an alternative embodiment, the front bracket system 104 includes one, solid arm portion without two protruding arm portions (not shown). According to one such an embodiment, the one, solid arm portion may have substantially the same dimensions as the base portion 120.

Figure 5:
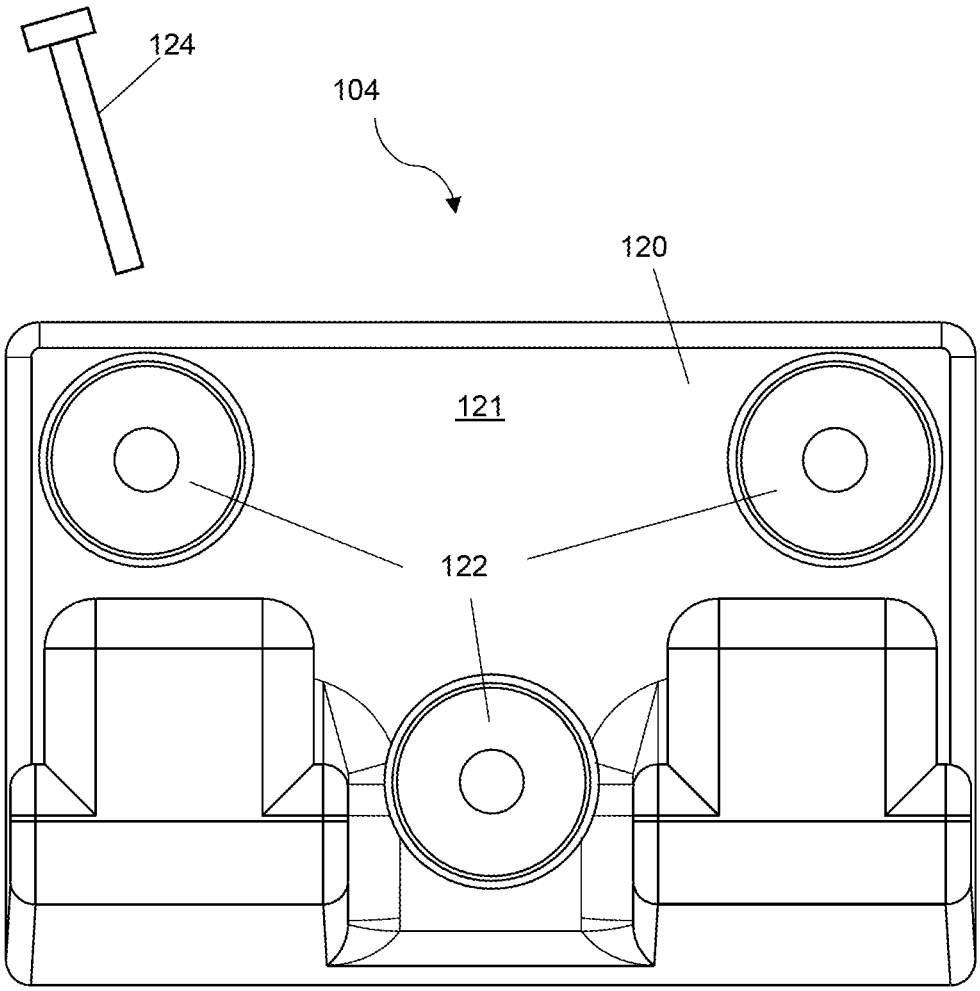
FIG. 5 is a top view of a front bracket system.

FIG. 5 provides a top view of a front bracket system 104. As illustrated, the front bracket system 104 includes a base portion 120 having a top surface 121 defining at least three openings 122 that traverse or pass completely through the entire base portion 120 to allow a fastener 124 to pass through. The fastener 124 may be any device for attaching the front bracket system 104 to a surface 126 (see FIG. 4B). The surface 126 may be the floor or deck of a watercraft (not shown). According to a preferred embodiment, the fastener 124 is a screw. The screw is preferably fabricated from a material that is resistant to rust or deterioration in a fresh or salt water environment. According to one embodiment, the fastener 124 is a stainless steel screw.

Figure 6A:
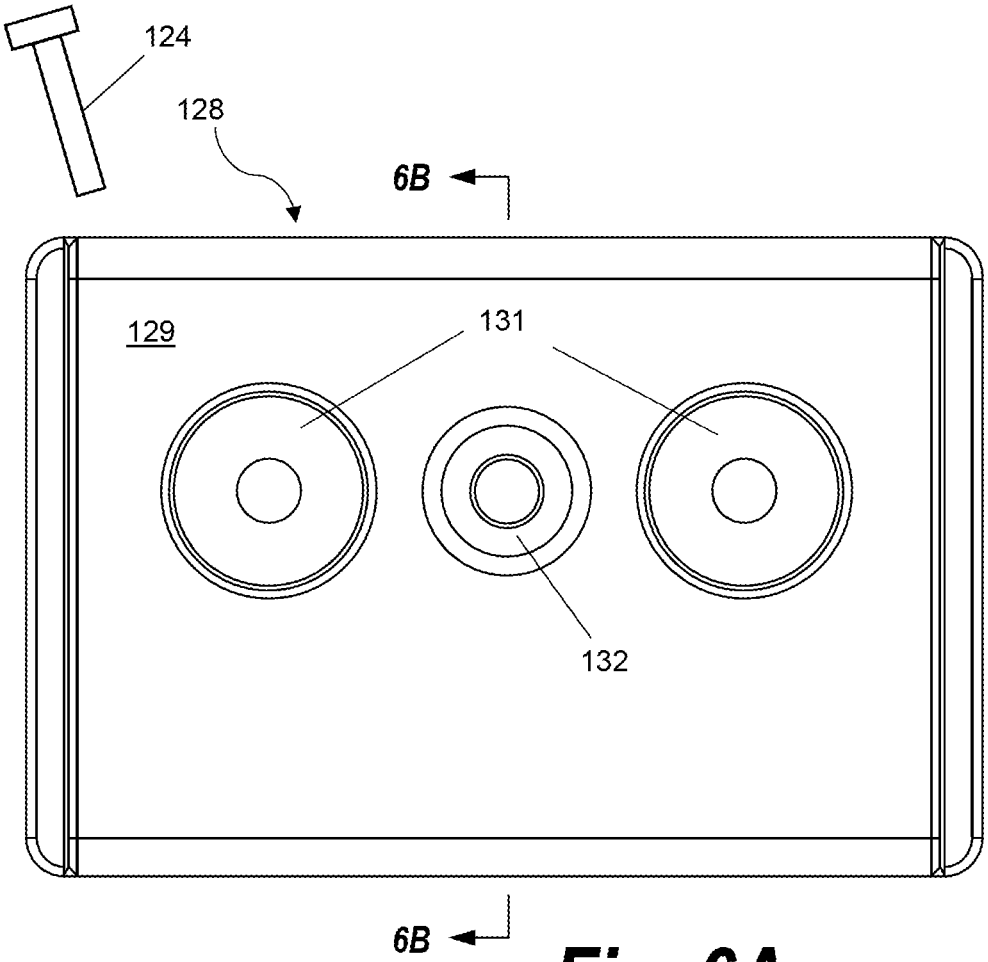
FIG. 6A is a top view of a rear bracket base.
Figure 6B:
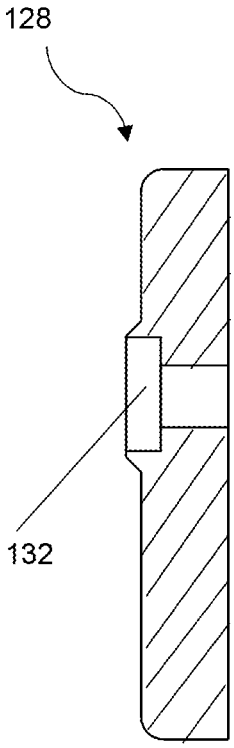
FIG. 6B is a cross-sectional view of the rear bracket base along line 6B in FIG. 6A.

FIG. 6A provides a top view of a base portion 128 of the rear bracket system 112 (with single arm portion 130 removed to expose base portion 128). The base portion 128 includes a top surface 129 defining at least two openings 131 that traverse or pass completely through the entire base portion 128 to allow a fastener 124 to pass through and into the surface 126. The base portion 128 includes a top surface 129 that also defines a third opening 132 that traverses or passes completely thought the entire base portion 128 (and single arm portion 130) to allow a fastener 124 to pass through (see also FIG. 6B) and into the surface 126. According to a preferred embodiment, the fastener 124 is a screw. The screw is preferably fabricated from a material that is resistant to rust or deterioration in a fresh or salt water environment. According to one embodiment, the fastener 124 is a stainless steel screw.

Figure 7A:
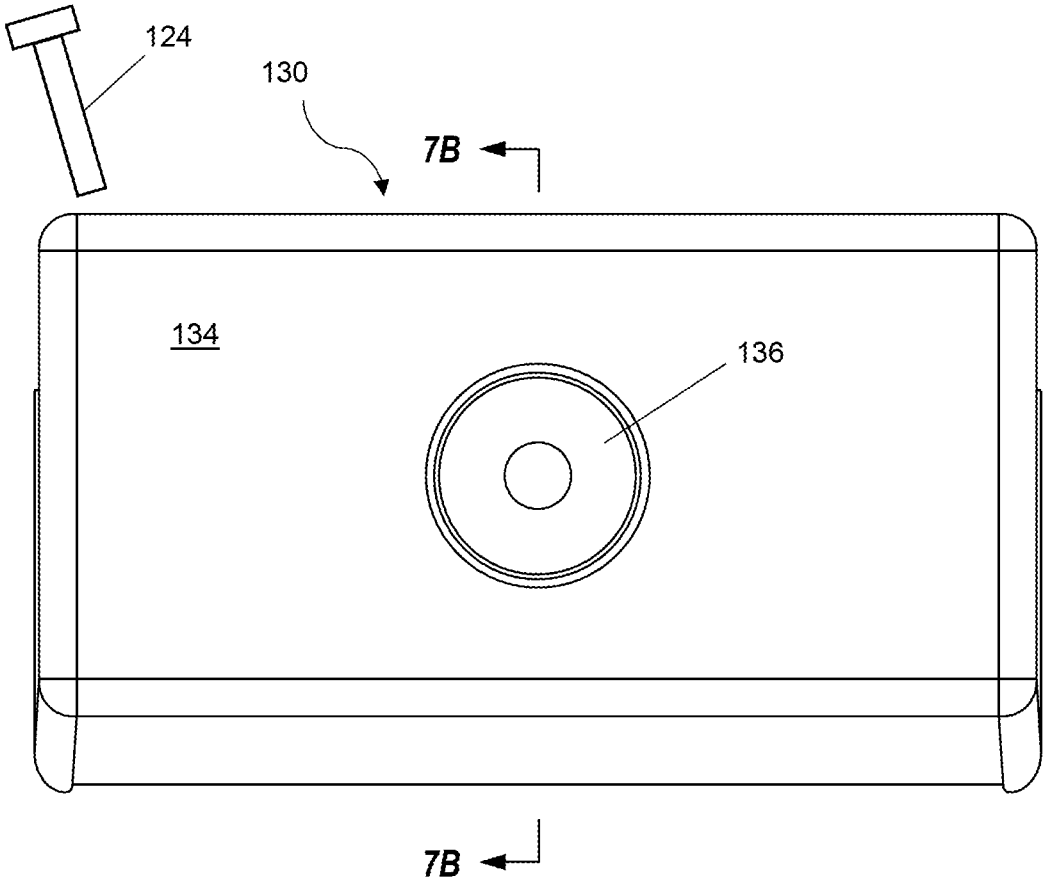
FIG. 7A is a top view of a rear bracket arm.
Figure 7B:
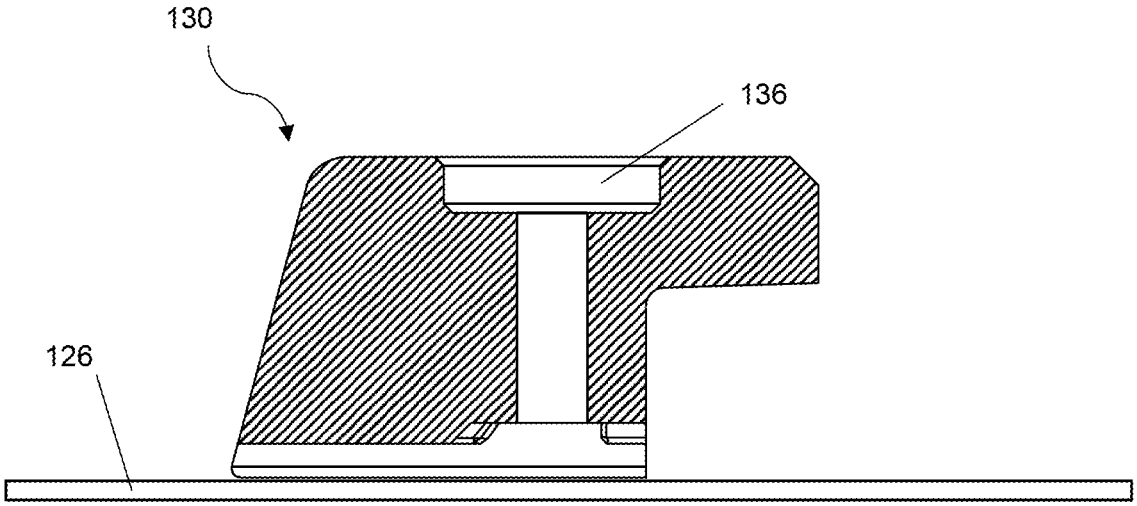
FIG. 7B is a cross-sectional view of a rear bracket arm along line 7B.

FIG. 7A provides a top view of a single arm portion 130 of the rear bracket system 112. According to an alternative embodiment, the arm portion includes at least two arm portions (not shown). The arm portion 130 includes a top surface 134 defining a single opening 136 that traverses or passes completely through the entire arm portion 130 to allow a fastener 124 to pass through (see also FIG. 7B). The single opening 136 aligns with the third opening 132 (see FIG. 6A). According to a preferred embodiment, the fastener 124 is a screw. The screw is preferably fabricated from a material that is resistant to rust or deterioration in a fresh or salt water environment. According to one embodiment, the fastener 124 is a stainless steel screw. The rear rail portion 114 (see e.g., FIGS. 2 and 3B) is of a vertical thickness substantially similar to the distance between the at least one single arm portion 130 and base portion 128 of the rear bracket system 112. Thus, the base portion 128 and at least one single arm portion 130 secure, engage, hold or otherwise grip the rear rail portion 114 (see FIGS. 2 and 3B).

The front bracket system 104 and rear bracket system 112 base portions (120, 128) and arm portions (118, 130) are each fabricated from at least one material that can support a cooler and withstand use in a fresh or saltwater environment. According to one embodiment, the base portions (120, 128) and arm portions (118, 130) are each fabricated from at least one material such as, for example, stainless steel, a non-corrosive metal, a polymer, an elastomer, a thermoplastic, a plastic or a thermosetting polymer. According to one embodiment, the base portions (120, 128) and arm portions (118, 130) are each fabricated via an injection molding process.

To prepare for use, the front bracket system 104 is secured to a surface 126 (see FIGS. 4B and 7B) via three fasteners 124. The three fasteners 124 are passed through the three openings 122 on the top surface 121 of the base portion 120 and into the surface 126. The base portion 128 of the rear bracket system 112 is also secured to the same surface 126 (see FIGS. 4B and 7B) via two fasteners 124 which are passed through the two openings 131 on the top surface 129 of the base portion 128 and into the surface 126. The spacing and location of the front bracket system 104 and base portion 128 of the rear bracket system 112 is based on the size of the base of the cooler 102. To secure a cooler 102 in the cooler mounting system 100, the front rail portion 106 is engaged and secured between the two arm portions 118 and base portion 120 of the front bracket system 112. The cooler 102 is then laid on the base portion 128 of the rear bracket system 112. The arm portion 130 of the rear bracket system 112 is then secured to the base portion 128 and the surface 126 with at least one fastener 124 that passes through the openings (136 and 132), through the base portion 128 and into the surface 126. The arm portion 130 is secured over the base portion 128 in a manner such that the arm portion 130 of the rear bracket system 112 engages, holds or otherwise grips the rear rail portion 114 of the cooler 102. Once the arm portion 130 of the rear bracket system 112 is secured, the cooler 102 is effectively locked in place and movement is prevented until the arm portion 130 of the rear bracket system 112 is unsecured and removed.

Although specific embodiments of the present invention are herein illustrated and described in detail, the invention is not limited thereto. The above detailed descriptions are provided as exemplary of the present invention and should not be construed as constituting any limitation of the invention. Modifications will be obvious to those skilled in the art, and all modifications that do not depart from the spirit of the invention are intended to be included with the scope of the appended claims.

We claim:

1. A cooler mounting system for a watercraft comprising at least one front bracket system mounted to a deck surface of the watercraft, the front bracket system comprising at least one arm portion and a base portion, the base portion having a top surface defining at least three openings that traverse the entire base portion and configured to receive at least one screw;

at least one rear bracket system comprising at least one arm portion and a base portion, the base portion of the rear bracket system mounted to the deck surface of the watercraft; and a cooler comprising a front rail portion located on a bottom and front face of the cooler and a rear rail portion located on a bottom and rear face of the cooler, wherein the front rail portion, the rear rail portion and cooler are unitary.

2. The cooler mounting system of claim 1, wherein the at least one front bracket system comprises at least two protruding arm portions.

3. The cooler mounting system of claim 1, wherein the at least one arm portion and the base portion of the front bracket system are configured to engage the front rail portion.

4. The cooler mounting system of claim 1, wherein the at least one arm portion and the base portion of the rear bracket system are configured to engage the rear rail portion.

5. The cooler mounting system of claim 1, further comprising at least four feet, wherein the feet include a vertical thickness so as to allow for alignment of: (a) the front rail portion between the at least two arm portions and base portion of the front bracket system; and (b) the rear rail portion between the at least one single arm portion and base portion of the rear bracket system.

6. The cooler mounting system of claim 1, wherein the least two arm portions and base portion of the front bracket system are formed from a single piece of material.

7. The cooler mounting system of claim 1, comprising two front bracket systems.

8. The cooler mounting system of claim 1, comprising two rear bracket systems.

9. The cooler mounting system of claim 1, wherein the rear bracket system includes a separate arm portion and base portion.

10. A cooler mounting system for a watercraft comprising at least one front bracket system mounted to a deck surface of the watercraft, the front bracket system comprising at least one arm portion and a base portion;

at least one rear bracket system comprising at least one arm portion and a base portion, the base portion mounted to the deck surface of the watercraft and having a top surface defining at least three openings that traverse the entire base portion and configured to receive at least one fastener, and the arm portion having a top surface defining a single opening that traverses the entire arm portion; and a cooler comprising a front rail portion located on a bottom and front face of the cooler and a rear rail portion located on a bottom and rear face of the cooler, wherein the front rail portion, the rear rail portion and cooler are unitary.

11. The cooler mounting system of claim 10, wherein the fastener is a screw.

12. A method of securing a cooler to a surface of a watercraft, the method comprising the steps of:

providing a cooler mounting system, the cooler mounting system comprising at least one front bracket system comprising at least one arm portion and a base portion;

at least one rear bracket system comprising at least one arm portion and a base portion; and a cooler comprising a front rail portion located on a bottom and front face of the cooler and a rear rail portion located on a bottom and rear face of the cooler, wherein the front rail portion, the rear rail portion and cooler are unitary;

securing the front bracket system to the surface of the watercraft;

securing the base portion of the rear bracket system to the deck surface of the watercraft;

placing the front rail portion between the at least one arm portion and the base portion of the front bracket system; and securing the arm portion of the rear bracket system against the rear rail portion and to the base portion of the rear bracket system.

* * * * *